US005515777A

United States Patent [19]

Sinn

[11] Patent Number: 5,515,777

[45] Date of Patent: May 14, 1996

[54] EMBOSSING SET-UP SYSTEM

[75] Inventor: Rolf Sinn, Leingarten, Germany

[73] Assignee: Karl Marbach GmbH & Co., Germany

[21] Appl. No.: 368,888

[22] Filed: Jan. 5, 1995

[30] Foreign Application Priority Data

Jan. 7, 1994 [DE] Germany ..... 9400196 U

[51] Int. Cl.[6] ..... B31F 1/07

[52] U.S. Cl. ..... 101/28; 101/382.1; 101/383

[58] Field of Search ..... 101/368, 390, 101/382.1, 383, 384, 481, 415.1, 16, 28

[56] References Cited

U.S. PATENT DOCUMENTS

| | | | |
|---|---|---|---|
| 2,271,540 | 2/1942 | Buckey | 101/383 |
| 2,283,587 | 5/1942 | Steinbach | 101/383 |
| 2,373,491 | 4/1945 | Murray | 101/382.1 |
| 2,418,007 | 3/1947 | Barnes et al. | 101/382.1 |
| 3,104,574 | 9/1963 | Andersen et al. | 101/384 |
| 4,537,124 | 8/1985 | Graboyes | 101/28 |
| 5,095,830 | 3/1992 | Love | 101/28 |
| 5,736,936 | 8/1992 | Holliday | 101/383 |

*Primary Examiner*—Eugene H. Eickholt
*Attorney, Agent, or Firm*—Marshall & Melhorn

[57] ABSTRACT

An embossing set-up system is disclosed for setting the position of at least one embossing die on the working side of a working die plate, in which system the embossing die features through holes extending perpendicularly to the working side of the die plate, and through which holes extends a threaded element. Each such threaded element is provided with a threaded shank and a head, the free end of the shank engaging a tapped hole in the die plate, and the cross section of the head being larger, and the cross section of the threaded shaft being smaller, than the cross section of the relevant through hole.

45 Claims, 2 Drawing Sheets

EMBOSSING SET-UP SYSTEM

Figure 1:
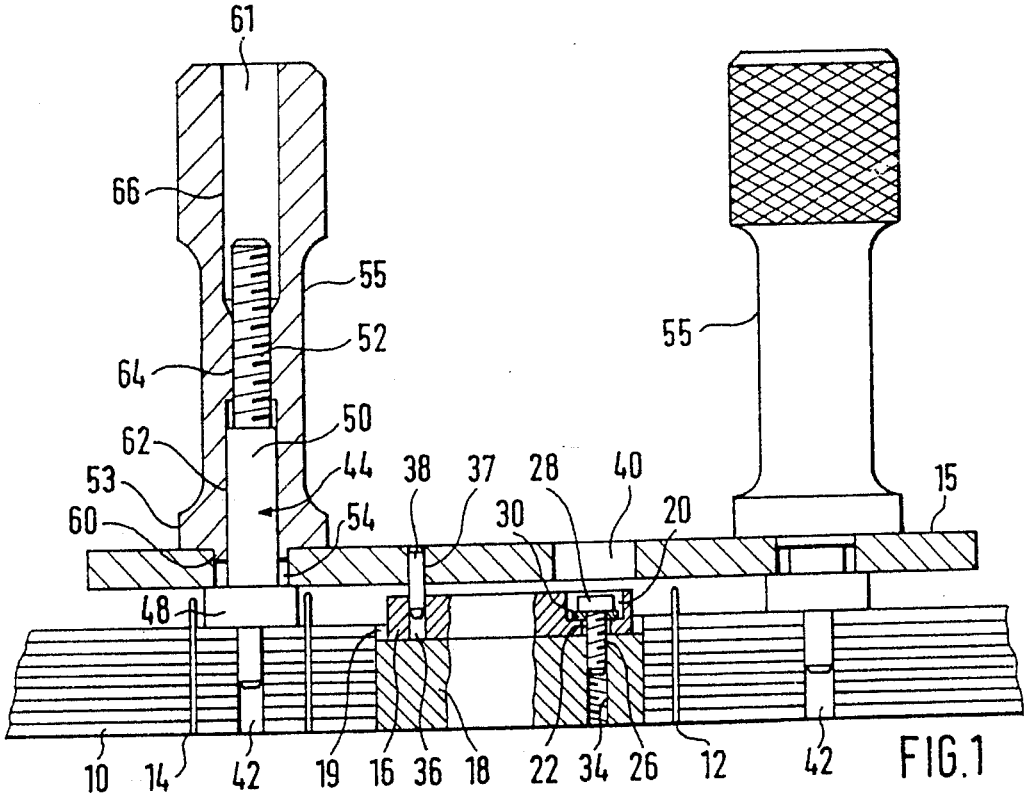

The invention concerns an embossing set-up system for setting the position of at least one embossing die on the working side of a die plate, in which system the embossing die features through holes extending perpendicularly to the working side of the die plate and through which holes extends a threaded element each provided with a threaded shank and a head, the free end of the shank engaging a tapped hole in the die plate, and the cross section of the head being larger, and the cross section of the threaded shaft smaller than the cross section of the relevant through hole.

Die plates with embossing dies arranged on their working side are used, e.g., for embossing emblems on packaging blanks. For that purpose, blanking and scoring lines are arranged on the working side of the die plate that extend beyond the embossing die. A die plate is used to simultaneously stamp a set of several packaging blanks into a sheet including scoring and embossing. Proper embossing requires exact alignment of the imprint contained on the sheet and to be embossed, with the embossing profile on the embossing die, so that no offset will be created between imprint and embossing.

With prior arrangements, a trial run is carried out first on a sheet for set-up of the embossing dies. Basing on the result, the threaded elements of the individual embossing dies are loosened and then shifted, for instance by tapping with a hammer, in such a way that the embossing profile of the die coincides with the imprint to be embossed, on the packaging blank. Normally, this requires several set-up operations for each embossing die. In the case of a die plate for use of, e.g. sixty embossing, the set-up time on the press amounts normally to more than twelve hours, during which time the machine is down. Therefore, the down time of the machine is very long, which has a considerable effect on the production cost of the embossed blanks.

Therefore, the problem underlying the invention is to create with means of simple design an embossing set-up system which allows positioning of the embossing dies within a short time.

Basing on the initially cited prior art, this problem is solved by providing two locating openings in the surface of the embossing die away from the die plate and at least two adjustment holes in the working side of the die plate. Additionally provided is a template on which at least two locating pins are mounted that extend toward the die plate and engage the locating openings. Additionally, there are at least two adjustment pins fastened to the template, which pins enter adjustment holes while the locating pins engage the locating openings.

Using the inventional set-up system, a preadjustment of the embossing dies can be achieved at the toolmaker's within a short time. The preadjustment is so selected that the profile of the embossing die will be so arranged on the die plate shipped that embossing will occur exactly at the correct point of the sheet to be embossed. Such preadjustment can be made, e.g., on the basis of an embossing stand film. Hence, the inventional embossing set-up system not only simplifies the assembly operation, but safeguards also a uniform mounting of all copies on a die plate.

The adjustment pins are preferably arranged concentrically on the end of an adjustment bolt that extends through a through hole in the template, the cross section of the through hole being larger than the cross section of the adjustment bolt in the area of the through hole.

A preadjustment system is preferably provided by which the adjustment bolts can be secured on the template concentric with the through hole.

The through hole is favorably cylindrical and the adjustment bolt provided with an external threading on its end opposite the adjustment pin. The preadjustment system features a hole with an internal threading which is able to engage the external threading of the adjustment bolt once the preadjustment device has been slipped on the end of the adjustment bolt opposite the adjustment pin. An axial annular projection provided on the end of the preadjustment device facing toward the template, its outside diameter corresponding to the inside diameter of the through hole, safeguards an arrangement of the adjustment pin concentric with the through hole in the template.

In a preferred embodiment of the invention, the position of the adjustment pin relative to the template is adjustable by means of a fine-adjustment device. It enables a quick and easy fine-adjustment of the embossing dies, especially with the die plate containing the embossing installed in a blanking press.

In this embodiment, the fine-adjustment system features preferably a base through which extends an axial through hole and which allows a stationary mounting on the template such that the through hole is essentially aligned on the through opening in the template, with the adjustment bolt traversing the through hole. Provided additionally are oblong fine-adjustment elements which with one end extend radially into the through hole in the base and are adjustable in their length relative to the base, with the cross section of the through hole being larger than the cross section of the adjustment bolt in this area.

The template can be shifted to the desired extent, relative to the adjustment bolts, by adjustment of the fine-adjustment elements.

There are suitable two fine-adjustment elements provided, arranged at an angle of 90° relative to each other. Provided at an angle of about 135° to each of the fine-adjustment elements, radially, is a prestressed spring element which extends into the through hole and acts on the adjustment bolt. Said spring element insures that the ends of the fine-adjustment elements will always be in contact with the adjustment bolt, so that the template can be adjusted without play.

A very fine adjustment is possible when the fine-adjustment elements are fashioned as micrometer screws. Possible is also a digital, reproducible determination of the positions.

The outer cross section of the preadjustment system end face on the near side of the template is favorably larger than the cross section of the through hole, and the adjustment bolt features preferably a spacing point between template and embossing die plate whose cross section is larger than the cross section of the hole in the template. This makes it possible to clamp the template and the fine-adjustment device in place relative to the adjustment bolt, by screwing the preadjustment device on the end of the adjustment bolt provided with the external threading.

A simple arrangement of the template is possible when it consists of transparent material, preferably plexiglass.

Figure 2:
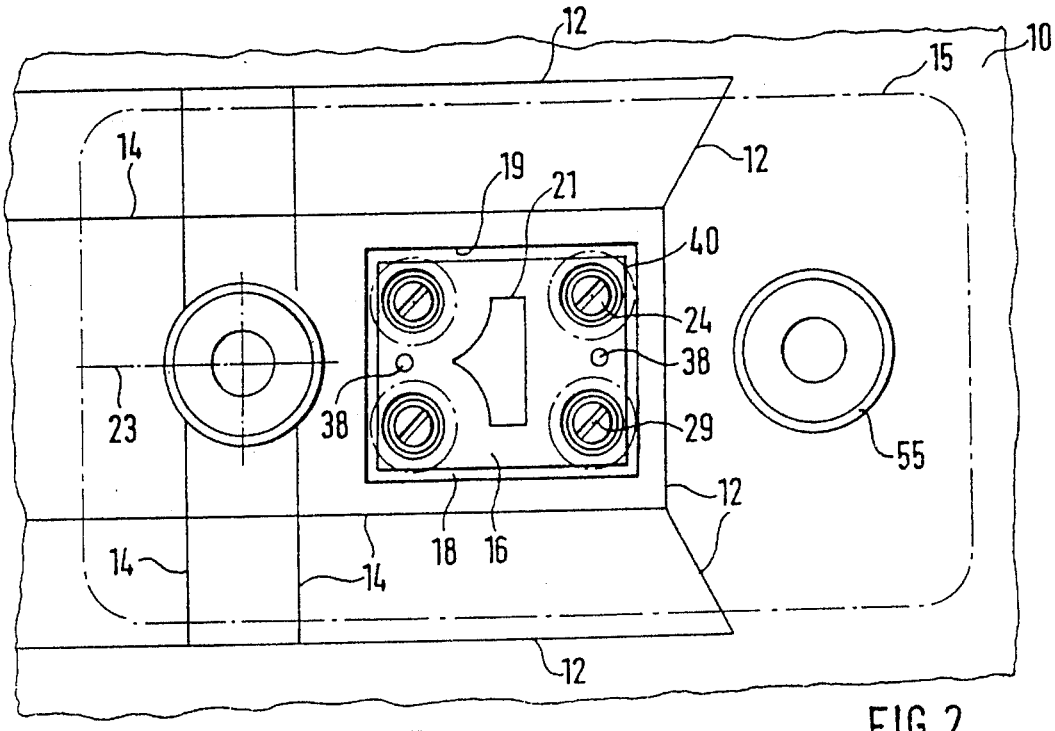
Figure 3:
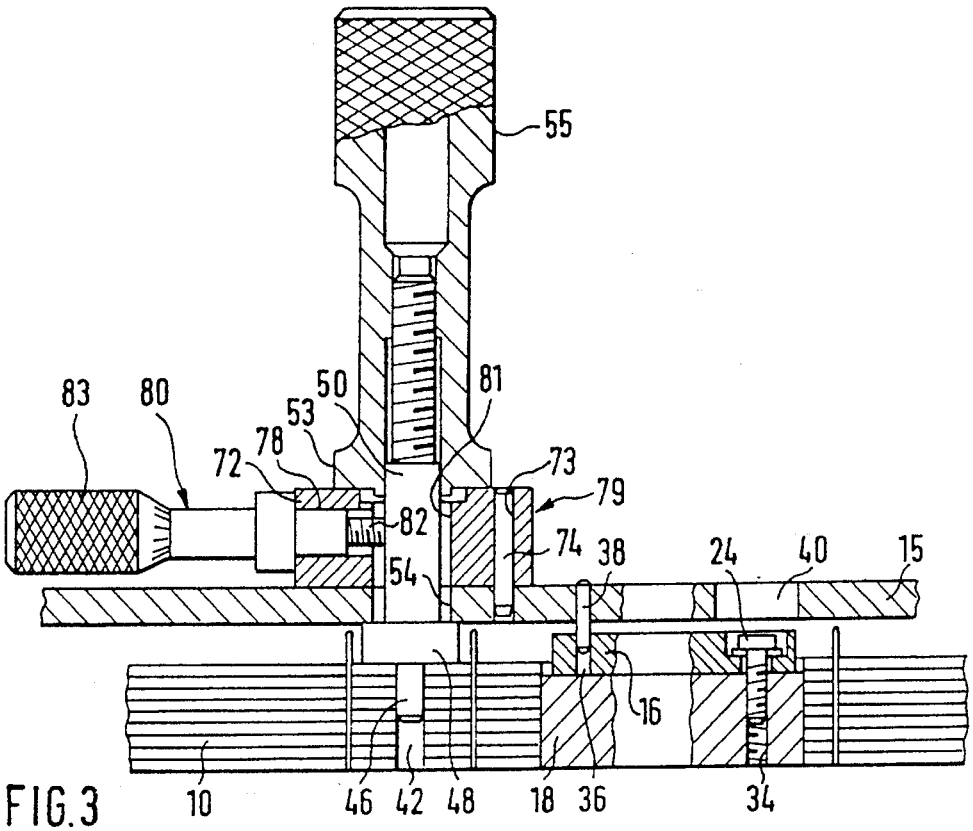
Figure 4:
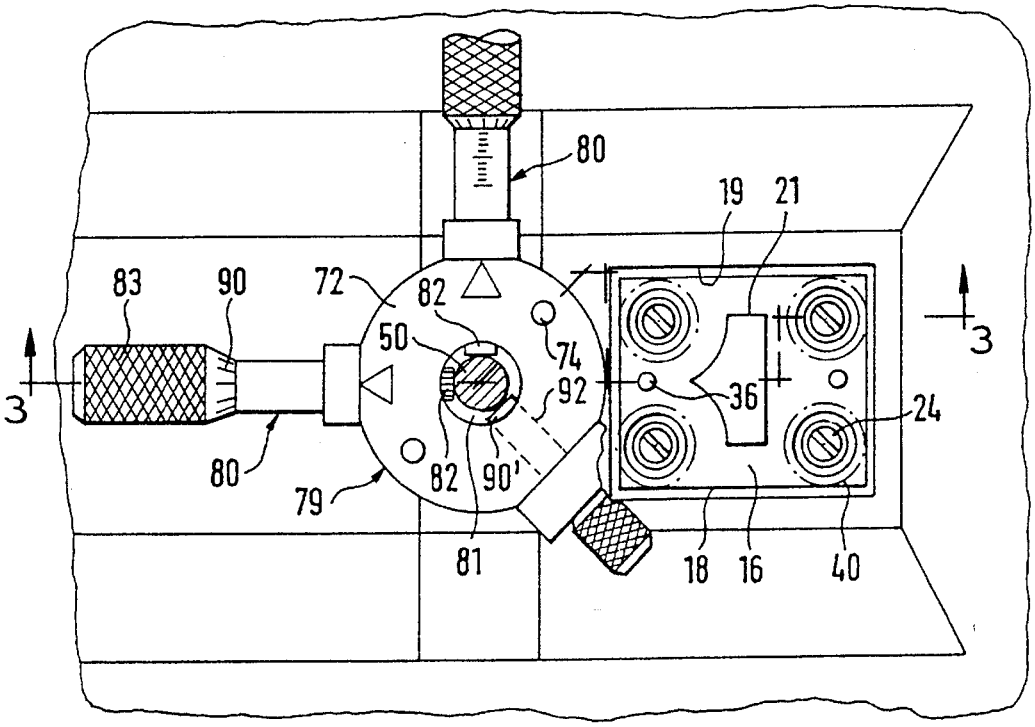

An embodiment of the invention will be more fully explained hereafter with the aid of drawings, which show in FIG. 1, the cross section of a die plate with a set-up system for prelocating of embossing dies;

FIG. 2, a plan view of the die plate and the embossing set-up system of FIG. 1;

FIG. 3, a sectional view taken in the direction of the arrows along the section line 3—3 of FIG. 4;

FIG. 4, a plan view of the die plate with the embossing set-up system relative to FIG. 3.

Illustrated in FIG. 1 and 2 is a section of a copy on a die plate 10 suitable for making a blank for a cigarette case. The embossing die plate is provided with several such copies, making it possible to produce simultaneously several identical blanks for cigarette cases with the one embossing die plate 10. Arranged in the latter in customary fashion are scoring lines 14 and cutting lines 12 which with their upper end protrude at the top side of the embossing die plate 10.

Provided additionally in the embossing die plate 10 is a rectangular aperture 19 which extends from the bottom side to the top side and in which a square die block 18 of aluminum is fitted, its top side ending somewhat below the top side of the die plate 10. Mounted on the top side of the die block 18 is a rectangular, plate-shaped matrix 16 with a profile 21 provided on its top side. A spacing between the peripheral edge of the rectangular aperture 19 and the peripheral edge of the matrix 16 enables a certain shifting of the matrix 16 within the rectangular aperture 19, for adjusting the matrix position to the imprint to be embossed.

For mounting the matrix 16 there are four tapped holes 34 provided, in the four corner areas of the die block 18, which extend perpendicularly to the top side of the die block 18. The matrix 16 has four through holes 22 which extend perpendicularly to its top side and coincide with a tapped hole 34 in the die block 18. Each through hole 22 extend upwardly, by way of a rectangular step, into a cylindrical recess 20 in the embossing matrix 16, ending at the top side of matrix 16 and having a diameter larger than the diameter of the through hole 22. The diameter of the through hole 22 is larger than the diameter of the tapped hole 34 in the die block 18, in order to allow shifting the matrix 16 sideways.

An externally threaded shank 26 of a screw 24 extends through each through hole 22. The external threading of the shank 26 meshes with the internal threading of the hole 34. The outside diameter of the shank 26 is smaller than the inside diameter of the through hole 22. Moreover, the screw 24 has a head 28 whose outside diameter is larger than the inside diameter of the through hole 22. The head 28 is arranged within the recess 20 in the embossing matrix and features on its end face a slot 29. Besides, the shank 26 of the screw 24 extends through a washer 30 whose outside diameter is larger than the inside diameter of the through hole 22, which washer is arranged between the underside of the head 28 and the bottom of the recess 20. Provided in the die plate 10, on the longitudinal center line 23 of the copy and on both sides of the embossing matrix 16, are cylindrical adjustment holes 42 that extend from the top side the bottom side of the die plate 10.

A cylindrical adjustment pin 46 on the bottom end of an adjustment bolt 44 is inserted in the adjustment holes 42. The outside diameter of the adjustment pin 46 corresponds essentially to the inside diameter of the relevant adjustment hole 42.

Adjacent to the adjustment pin 46, each adjustment bolt 44 has a cylindrical spacing collar 48 whose outside diameter is larger than the inside diameter of the adjustment hole 42. The spacing collar 48 of the adjustment bolt 44 is followed by an adjustment shank 50 whose outside diameter is smaller than the outside diameter of the spacing collar 48. Bordering on the adjustment shank 50, on the end of adjustment bolt 44 opposite the pin 46, is a cylindrical section 52 with an external threading, the outside diameter of which section is smaller than the outside diameter to the adjustment shank 50.

Placed on the adjustment bolts 44 is a plate-shaped template 15 with two through holes 54 through which extends the shank 50 of the relevant adjustment bolts 44. The inside diameter of the through holes 54 is larger than the outside diameter of the relevant adjustment shank 50 and smaller than the outside diameter of the respective spacing collar 48 of the locating bolt 44. The plate-shaped template 15, therefore, bears with its underside on the top side of the collar 48, which latter bears with its underside on the top side of the die plate 10. Therefore, the spacing collar 48 determines the spacing between template 15 and the top side, or working side, of the die plate 10.

Screwed on the end of adjustment bolt 44 opposite the adjustment pin 46 is a sleeve type preadjustment device 55 through which extends coaxially a hole 61. Said hole 61 has on its bottom section an inside diameter corresponding essentially to the outside diameter of the adjustment shank 50. Provided in the center area of the hole 61 is an internal threading 64 that meshes with the external threading of the adjustment bolt 44. Following the internal threading 64 is a section 66, of the hole 61, whose inside diameter is larger than the outside diameter of the external threading of adjustment bolt 44.

The preadjustment device 55 features on its lower end an annular flange 53 whose outside diameter is larger than the inside diameter of the through hole 54. The annular flange 53 bears with its lower end face on the top side of the template 15. Bordering on its annular flange 53, the preadjustment device 55 features on its end an annular projection 60 whose inside diameter matches essentially the outside diameter of the adjustment shank while its outside diameter corresponds essentially to the inside diameter of the through hole 54. The annular projection 60 extends into the through hole 54, for which reason the arrangement of adjustment bolt 44 is concentric with the through hole 54.

Provided additionally in the template 15 are two through holes 37, in each of which a cylindrical locating pin 38 is arranged in a fashion such that it protrudes downward and perpendicularly to the underside of the template 15. The locating pins 38 engage each a cylindrical locating hole 36 in the adjustment matrix 16, said hole being in alignment with the locating pins 38 and their inside diameter corresponding essentially to the outside diameter of the locating pin 38.

Additionally, through holes 40 are provided in the template, above each of the screws 24.

A preliminary adjustment of the embossing matrix 16 can be accomplished within shortest time using the set-up system illustrated in FIG. 1 and 2. The position of through holes 54, through holes 37 and apertures 40 relative to the adjustment holes 42 in the die plate 10 is predetermined in such a way that the embossed profile 21 on the embossing matrix 16 coincides exactly with the imprint on the blank that is to be embossed.

For preliminary locating of the matrices 16, the adjustment bolts 44 are pushed first through the through holes 54 and fastened by screwing the preadjustment device 55 in place concentric with the through hole 54. Next, the embossing matrices 16 are with their locating holes 36 slipped on the locating pins 38 on the template 15.

Thereafter, the template 15 is assembled on the die plate 10, along with the embossing matrix 16, in such a way that the adjustment pins 46 engage the adjustment holes 42 in the die plate 10. Embossing matrix 16 is now positioned exactly over the die block 18. The through holes 22 in the embossing matrix 16 coincide with the tapped holes 34 in the die block. Embossing matrices 16 are now forced down on the top side of the die block 18, for instance by means of a screwdriver passed through aperture 40. Lastly, the screws 24 are inserted in the through holes 22 through aperture 40, screwed in the respective tapped hole 24 and tightened to secure the matrix 16. In a final step, the template 15 is removed from the die plate 10, along with the preadjustment devices 55, adjustment bolts 44 and locating pins 38. The embossing matrix 16 is now preadjusted. This preadjustment is carried out in the same way for all embossing matrices 16 of the die plate 10.

The design of the embossing set-up system may be such that two or more embossing matrices 16 of a blank can be preadjusted simultaneously.

Preadjusted in this way, the die plate 10 is shipped together with the set-up system to the packaging manufacturer for installation in the blanking tool. Next, a trial sheet is placed in the tool and blanks are punched, scored and embossed. If the embossing coincides exactly with the imprint on the sheet, no readjustment of individual matrices 16 is required.

Normally, however, the matrices 16 need to be readjusted, on account of thermal and dynamic effects. For that purpose there are two fine-adjustment systems 79 provided, of which one is illustrated in FIG. 3 and 4.

The fine-adjustment device 79 consists of an annular base 72 with a cylindrical through hole 81, the diameter of which corresponds essentially to the diameter of the through hole 54 in the template 15. Provided in the base 72 are two radial cylindrical holes 78 extending at an angle of 90° relative to each other. Inserted in each cylindrical hole 78 is a micrometer screw 80 which on its exposed end outside the base 72 features a thimble 83. Turning the latter allows length adjustment of the micrometer screw end 82 extending radially in the through hole 81.

Provided additionally, in the base 72, is a radial hole 92 that extends at an angle of about 135° to the cylindrical holes 78. The latter and the radial holes 92 are situated in one plane. A radially prestressed spring element 90' is provided in the radial hole 92 and protrudes with one end in the through hole 81.

For mounting the base 72 on the template 15, the base 72 features two diametrically opposed axial holes 73 which are in alignment with the holes 77 in the template 15 when placing the base 72 on the template in such a way that the through hole 54 is aligned on the through hole 81. To mount the base 72 on the template 15, a mounting pin 74 is provided that extends through the axial hole 73 and the respective hole 77.

The not illustrated fine-adjustment system is fashioned in the same as the one shown in FIG. 3 and 4 and arranged on the other through hole 54 in the same fashion.

To fine-adjust the embossing matrices 16, adjustment bolts 44 with adjustment pins 46 are inserted in the adjustment holes 42 in the die plate 10. This is followed by placing the template 15 on the adjustment bolts 44 in a way such that the locating pins 38 snap into the locating holes 36 in the embossing matrices 16.

Now, the base 72 of the fine-adjustment system 79 is placed on the template 15 in such a way that the mounting pins 74 provided in the axial holes 73 engage the holes 77 in the template 15. The through hole 81 is now aligned on the through hole 74. The micrometer screws 80 have been backed off sufficiently for the adjustment pin 44 to extend through the through hole 81. The prestressed spring element 90' pushes on the outside surface of adjustment shank 50.

Next, the preadjustment devices 55 are screwed on the adjustment bolts 44. The micrometer screws 80 are backed off on their thimble 83 until the end 82 extending in the through hole 81 bears on adjustment shank 50. Now, the screws 24 are released and the preadjustment system loosened such that the template 15 can be moved along with the engaged embossing matrix 16.

Template 15 can now be adjusted to the desired extent relative to adjustment bolt 44, by turning the thimble 83 of the micrometer screws 80, since the inside diameter of the through hole 54 is larger than the outside diameter of adjustment shank 50. The spring element 90' safeguards that the ends 82 of the micrometer screws 80 are always in contact with the adjustment shanks 50, so that no play exists between adjustment shanks 50 and pins 82 of the micrometer screws 80. The micrometer screws 80 are provided with a scale 90 and their design is such that their end 82 will move 0.01 mm in radial direction as the thimble 80 is turned one scale line.

Once the template 15 has by rotation of the micrometer screws 80 been adjusted to the desired extent, the preadjustment system 55 is tightened. Next, the embossing matrices 16 are screwed tight, followed by removing the mounted template 15.

Template 15 is now adjusted to a new locating measurement. Fine-adjustment of the embossing can now be carried out quickly and exactly for each further copy on the die plate 10. To that end, the matrices 16 are released, followed by placement of the template 15 that was mounted in the first fine-adjustment procedure and insertion of the locating pins 38 in the locating holes 36. Backlash between shank 26 of the screws 24 and the walls of the hole 22 allows a shifting of the matrices 16. Thereafter, the matrices 16 are retightened, followed by removal of the previously mounted template 15.

What is claimed is:

1. Embossing set-up system for setting the position of at least one embossing matrix (16) on the working side of a die plate (10), in which system the embossing matrix (16) features through holes (22) which extend perpendicularly to the working side of the die plate (10) and through which extends a threaded element (24) provided with a shank (26) and a head (28), the exposed end of the shank (26) engaging a tapped hole (34) in the die plate (10), and the cross section of the head (28) being larger, the cross section of the shank (26) smaller than the cross section of the respective through hole (22), characterized by at least two locating holes (36) in the surface of the embossing matrix (16) away from the die plate (10), at least two adjustment holes (42) in the working side of the die plate (10), a template (15) to which there are secured at least two locating pins (38) that extend toward the die plate (10) and engage the locating holes (36), and at least two adjustment pins (46) that are secured to the template (15) and engage the adjustment holes (42), while the locating pins (38) engage the locating holes (36).

2. Embossing set-up system according to claim 1, characterized in that the adjustment pins (46) are arranged on an end of an adjustment bolt (44) which extends through a through hole (54) in the template (15), the cross section of the through hole (54) being larger than the cross section of the adjustment bolt (44) in the area of the through hole (54).

3. Embossing set-up system according to claim 2, and including a preadjustment system (55) by which the adjustment bolt (44) can be secured to the template (15) concentric with the through hole (54).

4. Embossing set-up system according to claim 3, characterized in that the through hole (54) is cylindrical, in that the adjustment bolt (44) is on its end opposite the adjustment pin (46) provided with an external threading, in that the preadjustment system (55) features a hole (62, 64, 66) with an internal threading adapted to engage the external threading of the adjustment bolt (44) when the preadjustment system (55) has been placed on the end of the adjustment bolt (44) opposite the adjustment pin (46), and in that on the end of the template (15) facing the preadjustment system (55) there is an axial annular projection (60) provided whose outside diameter corresponds to the inside diameter of the through hole (54).

5. Embossing set-up system according to claim 3, characterized in that the position of the adjustment pin (46) relative to the template (15) is adjustable by a fine-adjustment system (79).

6. Embossing set-up system according to claim 5, characterized in that the fine-adjustment system (79) features a base (72) with an axial through hole (81), the base allowing stationary mounting on the template (15) in a manner such that the through hole (81) is essentially aligned on the through hole (54) of the template (15) and the adjustment bolt (44) extends through the through hole (81), and in that there are oblong fine-adjustment elements (80) provided which with one end (82) extend radially in the through hole (81) of the base (72) and allow adjustment of their length relative to the base (72), with the cross section of the through hole (81) being larger than the cross section of the adjustment bolt (44) in this area.

7. Embossing set-up system according to claim 6, characterized by two fine-adjustment elements (80) arranged at an angle of 90° to each other and by a prestressed spring element (92) which at an angle of about 135° to each fine-adjustment element (80) extends radially in the through hole (81) and acts on the adjustment bolt (44).

8. Embossing set-up system according to claim 6, characterized in that the fine-adjustment elements (80) are formed by micrometer screws.

9. Embossing set-up system according to claim 5, characterized in that the outer cross section of the end of the preadjustment system (55) facing the template (15) is larger than the cross section of the through hole (81), and in that the adjustment bolt (44) features between template (15) and die plate (10) a spacing collar (48) whose cross section is larger than the cross section of the through hole (54) in the template (15), so that the template (15) and the fine-adjustment system (79) can be clamped in place relative to the adjustment bolt (44) by screwing the preadjustment system (55) on the end of the adjustment bolt (44) provided with the external threading.

10. Embossing set-up system according to claim 2, characterized in that the position of the adjustment pin (46) relative to the template (15) is adjustable by a fine-adjustment system (79).

11. Embossing set-up system according to claim 3, characterized in that the position of the adjustment pin (46) relative to the template (15) is adjustable by a fine-adjustment system (79).

12. Embossing set-up system according to claim 4, characterized in that the position of the adjustment pin (46) relative to the template (15) is adjustable by a fine-adjustment system (79).

13. Embossing set-up system according to claim 11, characterized in that the fine-adjustment system (79) features a base (72) with an axial through hole (81), the base allowing stationary mounting on the template (15) in a manner such that the through hole (81) is essentially aligned on the through hole (54) of the template (15) and the adjustment bolt (44) extends through the through hole (81), and in that there are oblong fine-adjustment elements (80) provided which with one end (82) extend radially in the through hole (81) of the base (72) and allow adjustment of their length relative to the base (72), with the cross section of the through hole (81) being larger than the cross section of the adjustment bolt (44) in this area.

14. Embossing set-up system according to claim 11, characterized in that the fine-adjustment system (79) features a base (72) with an axial through hole (81), the base allowing stationary mounting on the template (15) in a manner such that the through hole (81) is essentially aligned on the through hole (54) of the template (15) and the adjustment bolt (44) extends through the through hole (81), and in that there are oblong fine-adjustment elements (80) provided which with one end (82) extend radially in the through hole (81) of the base (72) and allow adjustment of their length relative to the base (72), with the cross section of the through hole (81) being larger than the cross section of the adjustment bolt (44) in this area.

15. Embossing set-up system according to claim 12, characterized in that the fine-adjustment system (79) features a base (72) with an axial through hole (81), the base allowing stationary mounting on the template (15) in a manner such that the through hole (81) is essentially aligned on the through hole (54) of the template (15) and the adjustment bolt (44) extends through the through hole (81), and in that there are oblong fine-adjustment elements (80) provided which with one end (82) extend radially in the through hole (81) of the base (72) and allow adjustment of their length relative to the base (72), with the cross section of the through hole (81) being larger than the cross section of the adjustment bolt (44) in this area.

16. Embossing set-up system according to claim 13, characterized by two fine-adjustment elements (80) arranged at an angle of 90° to each other and by a prestressed spring element (92) which at an angle of about 135° to each fine-adjustment element (80) extends radially in the through hole (81) and acts on the adjustment bolt (44).

17. Embossing set-up system according to claim 14, characterized by two fine-adjustment elements (80) arranged at an angle of 90° to each other and by a prestressed spring element (92) which at an angle of about 135° to each fine-adjustment element (80) extends radially in the through hole (81) and acts on the adjustment bolt (44).

18. Embossing set-up system according to claim 15, characterized by two fine-adjustment elements (80) arranged at an angle of 90° to each other and by a prestressed spring element (92) which at an angle of about 135° to each fine-adjustment element (80) extends radially in the through hole (81) and acts on the adjustment bolt (44).

19. Embossing set-up system according to claim 13, characterized in that the fine-adjustment elements (80) are formed by micrometer screws.

20. Embossing set-up system according to claim 14, characterized in that the fine-adjustment elements (80) are formed by micrometer screws.

21. Embossing set-up system according to claim 15, characterized in that the fine-adjustment elements (80) are formed by micrometer screws.

22. Embossing set-up system according to claim 16, characterized in that the fine-adjustment elements (80) are formed by micrometer screws.

23. Embossing set-up system according to claim 17, characterized in that the fine-adjustment elements (80) are formed by micrometer screws.

24. Embossing set-up system according to claim 18, characterized in that the fine-adjustment elements (80) are formed by micrometer screws.

25. Embossing set-up system according to claim 7, characterized in that the fine-adjustment elements (80) are formed by micrometer screws.

26. Embossing set-up system according to claim 10, characterized in that the outer cross section of the end of the preadjustment system (55) facing the template (15) is larger than the cross section of the through hole (81), and in that the adjustment bolt (44) features between template (15) and die plate (10) a spacing collar (48) whose cross section is larger than the cross section of the through hole (54) in the template (15), so that the template (15) and the fine-adjustment system (79) can be clamped in place relative to the adjustment bolt (44) by screwing the preadjustment system (55) on the end of the adjustment bolt (44) provided with the external threading.

27. Embossing set-up system according to claim 11, characterized in that the outer cross section of the end of the preadjustment system (55) facing the template (15) is larger than the cross section of the through hole (81), and in that the adjustment bolt (44) features between template (15) and die plate (10) a spacing collar (48) whose cross section is larger than the cross section of the through hole (54) in the template (15), so that the template (15) and the fine-adjustment system (79) can be clamped in place relative to the adjustment bolt (44) by screwing the preadjustment system (55) on the end of the adjustment bolt (44) provided with the external threading.

28. Embossing set-up system according to claim 12, characterized in that the outer cross section of the end of the preadjustment system (55) facing the template (15) is larger than the cross section of the through hole (81), and in that the adjustment bolt (44) features between template (15) and die plate (10) a spacing collar (48) whose cross section is larger than the cross section of the through hole (54) in the template (15), so that the template (15) and the fine-adjustment system (79) can be clamped in place relative to the adjustment bolt (44) by screwing the preadjustment system (55) on the end of the adjustment bolt (44) provided with the external threading.

29. Embossing set-up system according to claim 6, characterized in that the outer cross section of the end of the preadjustment system (55) facing the template (15) is larger than the cross section of the through hole (81), and in that the adjustment bolt (44) features between template (15) and die plate (10) a spacing collar (48) whose cross section is larger than the cross section of the through hole (54) in the template (15), so that the template (15) and the fine-adjustment system (79) can be clamped in place relative to the adjustment bolt (44) by screwing the preadjustment system (55) on the end of the adjustment bolt (44) provided with the external threading.

30. Embossing set-up system according to claim 13, characterized in that the outer cross section of the end of the preadjustment system (55) facing the template (15) is larger than the cross section of the through hole (81), and in that the adjustment bolt (44) features between template (15) and die plate (10) a spacing collar (48) whose cross section is larger than the cross section of the through hole (54) in the template (15), so that the template (15) and the fine-adjustment system (79) can be clamped in place relative to the adjustment bolt (44) by screwing the preadjustment system (55) on the end of the adjustment bolt (44) provided with the external threading.

31. Embossing set-up system according to claim 14, characterized in that the outer cross section of the end of the preadjustment system (55) facing the template (15) is larger than the cross section of the through hole (81), and in that the adjustment bolt (44) features between template (15) and die plate (10) a spacing collar (48) whose cross section is larger than the cross section of the through hole (54) in the template (15), so that the template (15) and the fine-adjustment system (79) can be clamped in place relative to the adjustment bolt (44) by screwing the preadjustment system (55) on the end of the adjustment bolt (44) provided with the external threading.

32. Embossing set-up system according to claim 15, characterized in that the outer cross section of the end of the preadjustment system (55) facing the template (15) is larger than the cross section of the through hole (81), and in that the adjustment bolt (44) features between template (15) and die plate (10) a spacing collar (48) whose cross section is larger than the cross section of the through hole (54) in the template (15), so that the template (15) and the fine-adjustment system (79) can be clamped in place relative to the adjustment bolt (44) by screwing the preadjustment system (55) on the end of the adjustment bolt (44) provided with the external threading.

33. Embossing set-up system according to claim 7, characterized in that the outer cross section of the end of the preadjustment system (55) facing the template (15) is larger than the cross section of the through hole (81), and in that the adjustment bolt (44) features between template (15) and die plate (10) a spacing collar (48) whose cross section is larger than the cross section of the through hole (54) in the template (15), so that the template (15) and the fine-adjustment system (79) can be clamped in place relative to the adjustment bolt (44) by screwing the preadjustment system (55) on the end of the adjustment bolt (44) provided with the external threading.

34. Embossing set-up system according to claim 16, characterized in that the outer cross section of the end of the preadjustment system (55) facing the template (15) is larger than the cross section of the through hole (81), and in that the adjustment bolt (44) features between template (15) and die plate (10) a spacing collar (48) whose cross section is larger than the cross section of the through hole (54) in the template (15), so that the template (15) and the fine-adjustment system (79) can be clamped in place relative to the adjustment bolt (44) by screwing the preadjustment system (55) on the end of the adjustment bolt (44) provided with the external threading.

35. Embossing set-up system according to claim 17, characterized in that the outer cross section of the end of the preadjustment system (55) facing the template (15) is larger than the cross section of the through hole (81), and in that the adjustment bolt (44) features between template (15) and die plate (10) a spacing collar (48) whose cross section is larger than the cross section of the through hole (54) in the template (15), so that the template (15) and the fine-adjustment system (79) can be clamped in place relative to the adjustment bolt (44) by screwing the preadjustment system (55) on the end of the adjustment bolt (44) provided with the external threading.

36. Embossing set-up system according to claim 18, characterized in that the outer cross section of the end of the preadjustment system (55) facing the template (15) is larger than the cross section of the through hole (81), and in that the adjustment bolt (44) features between template (15) and die plate (10) a spacing collar (48) whose cross section is larger than the cross section of the through hole (54) in the template (15), so that the template (15) and the fine-adjustment system (79) can be clamped in place relative to the adjustment bolt (44) by screwing the preadjustment system (55) on the end of the adjustment bolt (44) provided with the external threading.

37. Embossing set-up system according to claim 8, characterized in that the outer cross section of the end of the preadjustment system (55) facing the template (15) is larger than the cross section of the through hole (81), and in that the adjustment bolt (44) features between template (15) and die plate (10) a spacing collar (48) whose cross section is larger than the cross section of the through hole (54) in the template (15), so that the template (15) and the fine-adjustment system (79) can be clamped in place relative to the adjustment bolt (44) by screwing the preadjustment system (55) on the end of the adjustment bolt (44) provided with the external threading.

38. Embossing set-up system according to claim 19, characterized in that the outer cross section of the end of the preadjustment system (55) facing the template (15) is larger than the cross section of the through hole (81), and in that the adjustment bolt (44) features between template (15) and die plate (10) a spacing collar (48) whose cross section is larger than the cross section of the through hole (54) in the template (15), so that the template (15) and the fine-adjustment system (79) can be clamped in place relative to the adjustment bolt (44) by screwing the preadjustment system (55) on the end of the adjustment bolt (44) provided with the external threading.

39. Embossing set-up system according to claim 20, characterized in that the outer cross section of the end of the preadjustment system (55) facing the template (15) is larger than the cross section of the through hole (81), and in that the adjustment bolt (44) features between template (15) and die plate (10) a spacing collar (48) whose cross section is larger than the cross section of the through hole (54) in the template (15), so that the template (15) and the fine-adjustment system (79) can be clamped in place relative to the adjustment bolt (44) by screwing the preadjustment system (55) on the end of the adjustment bolt (44) provided with the external threading.

40. Embossing set-up system according to claim 21, characterized in that the outer cross section of the end of the preadjustment system (55) facing the template (15) is larger than the cross section of the through hole (81), and in that the adjustment bolt (44) features between template (15) and die plate (10) a spacing collar (48) whose cross section is larger than the cross section of the through hole (54) in the template (15), so that the template (15) and the fine-adjustment system (79) can be clamped in place relative to the adjustment bolt (44) by screwing the preadjustment system (55) on the end of the adjustment bolt (44) provided with the external threading.

41. Embossing set-up system according to claim 25, characterized in that the outer cross section of the end of the preadjustment system (55) facing the template (15) is larger than the cross section of the through hole (81), and in that the adjustment bolt (44) features between template (15) and die plate (10) a spacing collar (48) whose cross section is larger than the cross section of the through hole (54) in the template (15), so that the template (15) and the fine-adjustment system (79) can be clamped in place relative to the adjustment bolt (44) by screwing the preadjustment system (55) on the end of the adjustment bolt (44) provided with the external threading.

42. Embossing set-up system according to claim 22, characterized in that the outer cross section of the end of the preadjustment system (55) facing the template (15) is larger than the cross section of the through hole (81), and in that the adjustment bolt (44) features between template (15) and die plate (10) a spacing collar (48) whose cross section is larger than the cross section of the through hole (54) in the template (15), so that the template (15) and the fine-adjustment system (79) can be clamped in place relative to the adjustment bolt (44) by screwing the preadjustment system (55) on the end of the adjustment bolt (44) provided with the external threading.

43. Embossing set-up system according to claim 23, characterized in that the outer cross section of the end of the preadjustment system (55) facing the template (15) is larger than the cross section of the through hole (81), and in that the adjustment bolt (44) features between template (15) and die plate (10) a spacing collar (48) whose cross section is larger than the cross section of the through hole (54) in the template (15), so that the template (15) and the fine-adjustment system (79) can be clamped in place relative to the adjustment bolt (44) by screwing the preadjustment system (55) on the end of the adjustment bolt (44) provided with the external threading.

44. Embossing set-up system according to claim 24, characterized in that the outer cross section of the end of the preadjustment system (55) facing the template (15) is larger than the cross section of the through hole (81), and in that the adjustment bolt (44) features between template (15) and die plate (10) a spacing collar (48) whose cross section is larger than the cross section of the through hole (54) in the template (15), so that the template (15) and the fine-adjustment system (79) can be clamped in place relative to the adjustment bolt (44) by screwing the preadjustment system (55) on the end of the adjustment bolt (44) provided with the external threading.

45. Embossing set-up system according to any one of claims 1–9 and 10–44, characterized in that the template (15) consists of transparent material.

* * * * *